US006901709B2

(12) United States Patent
Imus et al.

(10) Patent No.: US 6,901,709 B2
(45) Date of Patent: Jun. 7, 2005

(54) CONCRETE PANEL SKIRTING SYSTEM FOR MANUFACTURED HOMES AND METHOD FOR MAKING THE SAME

(76) Inventors: Richard G Imus, 115 Lind St., Mt. Vernon, WA (US) 98273; Richard S Imus, 115 Lind St., Mt.Vernon, WA (US) 98273; David A Imus, 115 Lind St., Mt. Vernon, WA (US) 98273

( * ) Notice: Subject to any disclaimer, the term of this patent is extended or adjusted under 35 U.S.C. 154(b) by 0 days.

(21) Appl. No.: 10/301,068

(22) Filed: Nov. 20, 2002

(65) Prior Publication Data

US 2003/0097804 A1 May 29, 2003

Related U.S. Application Data

(60) Provisional application No. 60/332,634, filed on Nov. 20, 2001.

(51) Int. Cl.[7] ..... E04B 2/56

(52) U.S. Cl. ..... 52/169.12; 52/582.1; 52/586.2

(58) Field of Search ..... 52/169.12, 582.1, 52/586.1, 586.2, 602

(56) References Cited

U.S. PATENT DOCUMENTS 1,509,424 A * 9/1924 Garrard ..... 52/779
3,722,156 A * 3/1973 Bryant ..... 52/169.12
4,335,548 A * 6/1982 Rehbein ..... 52/169.11
4,352,261 A * 10/1982 Wargo ..... 52/169.12
4,656,797 A * 4/1987 Marquart ..... 52/169.12
4,738,061 A * 4/1988 Herndon ..... 52/126.6
6,125,597 A * 10/2000 Hoffman et al. ..... 52/169.12
6,230,465 B1 * 5/2001 Messenger et al. ..... 52/630
6,374,552 B1 * 4/2002 Price ..... 52/169.12
2001/0009084 A1 * 7/2001 Wolfrum ..... 52/169.12

* cited by examiner

*Primary Examiner*—Peter R. Brown
(74) *Attorney, Agent, or Firm*—Todd N. Hathaway

(57) ABSTRACT

A system for skirting manufactured homes or similar buildings with modular concrete panels. The concrete panels are placed in edge-to-edge relationship about the perimeter of the building, and are secured to the rim joist by metal keys that interfit with adjoining edges of the panels. The lower edges of the panels are secure to the ground by cast-in tie-down straps through which stakes or other fasteners are driven. Each panel includes a wire rod reinforcement frame embedded in the concrete, and recessed areas for reducing weight. The panels may also include vent grills, flood vents and other openings. The panels are cast in pairs using a mold assembly having a stationary inner bulkhead and hinged outer bulkheads that pivot outwardly to release the panels when the concrete is set.

14 Claims, 7 Drawing Sheets

CONCRETE PANEL SKIRTING SYSTEM FOR MANUFACTURED HOMES AND METHOD FOR MAKING THE SAME

This application claims benefit of Provisional 60/332,634 filed Nov. 20, 2001.

BACKGROUND a. Field of the Invention

The present invention relates generally to manufactured homes installations, and, more particularly, to a system for providing skirting around manufactured home or similar building using pre-cast concrete panels.

b. Related Art

Examples of manufactured homes include both mobile homes and prefabricated houses. As in known in the art, manufactured homes are typically installed by transporting the home in one or more pieces and then assembling the pieces at the installation site. The bottom of the structure is usually positioned a spaced distance above the ground, so as to permit airflow and provide access to the bottom of the structure. This creates a gap around the perimeter of the structure, which must be covered, both for the sake of appearance and also to prevent excessive heat loss through the bottom of the home.

Conventionally, the edge gap is covered with a skirting constructed of wood e.g., plywood paneling. Although common, this approach presents several serious disadvantages. For example, conventional skirting often takes 2–3 days to complete, adding significantly to the time and cost of the installation, and the lumber itself is not inexpensive. Furthermore, soil is usually backfilled against the skirting to provide added insulation and a more finished appearance, and the resulting soil contact causes the wooden skirting to rot and deteriorate over time. Still further, in the event that the building is moved from its initial installation site (which is not uncommon in the case of manufactured homes), it is virtually impossible to remove and reuse the wood skirting, so that new skirting must be purchased and installed at the new location, thereby adding significantly to the cost of the move.

Accordingly, there exists a need for a skirting system for manufactured homes that can be installed with a minimum of time and labor. Furthermore, there exists a need for such a skirting system that uses low cost materials. Still further, there exists a need for such a skirting system that is durable and will not rot when placed in contact with soil and moisture. Still further, there exists a need for such a skirting system that is easily removed and reinstalled if the home is moved to a new location.

SUMMARY OF THE INVENTION

The present invention has solved the problems cited above, and is a system for skirting a manufactured home or similar building with modular panels.

Broadly, the method comprises the steps of (a) providing a plurality of substantially flat concrete panels having a height approximately equal to a predetermined height between a rim joist of the building and an underlying ground surface, (b) placing said panel members in edge-to-edge relationship between the rim joist and the underlying ground, (c) inserting locking members between adjoining edges of the panel members, so that the first and second edges of the locking members are received in corresponding edge slots of the panel members, and (d) securing upper ends of the locking members to the rim joist, so that the locking members maintains the panel members in edge-to-edge relationship and secure the panel members to the building.

The step of mounting the upper ends of the locking members to the rim joist of the building may comprise driving fasteners through an upper portion of the locking member and into the overlying joist.

The method may further comprise the step of securing lower edges of the panel members to the underlying ground. The step of securing the lower edges of the panel members to the underlying ground may comprise providing a tie-down member that is mounted to the lower edge of each panel member, and driving a fastener through the tie-down member and into the ground.

The method may further comprise the step of backfilling soil against outer surfaces of the concrete panels.

The invention also provides a modular panel member for skirting a manufactured home or similar building. Broadly, the panel member comprises a generally flat concrete panel having first and second end edges, an upper edge for fitting against a rim hoist of the building, and a lower edge for resting on underlining ground, each of the end edges having slots formed therein for receiving a key member that is mounted to the rim joist of the building, so that the key member secures adjoining panel members in vertical, edge-to-edge relationship beneath the rim joist.

The panel member may further comprise a wire rod reinforcement frame embedded in the concrete. Furthermore, the panel member may comprise at least one vent frame for permitting flow of ventilating air therethrough when installed.

The slots in the end edges of the panel member may extend over only an upper portion of the height thereof. The end slots may be tapered for insertion of a metal flange of the key member therein.

The panel member may be formed with at least one recessed area for reducing the total weight of the member. The panel member may also comprise a wooden furring strip mounted atop the upper edge thereof.

The key member for securing the panel members to the rim joist may comprise a vertically elongate metal member having first and second edge flanges for being received in the edge slots of the panel members. The key member may further comprise a mounting flange at the upper end of the vertically elongate member, for attachment to the rim joist by fasteners. The fasteners may be driven through the mounting flange or mounted thereto. The key member may also comprise a rearwardly extending flange for maintaining spacing between adjoining end edges of the panel members.

The invention also provides a method for forming the concrete skirting panels. The method comprises (a) providing a mold assembly having a stationary inner bulkhead and first and second outer bulkheads that are mounted on hinges in spaced, parallel relationship to the stationary bulkhead so as to form first and second mold cavities, (b) filling the first and second mold cavities with concrete slurry, and (c) pivoting the outer bulkheads away from the inner bulkhead about the hinges so as to release the concrete panel members from the mold cavities when at least partially cured.

These and other features are advantages of the present invention will be apparent from a reading of the following detailed description with reference to accompanying drawings.

DETAILED DESCRIPTION a. Overview

Figure 1:
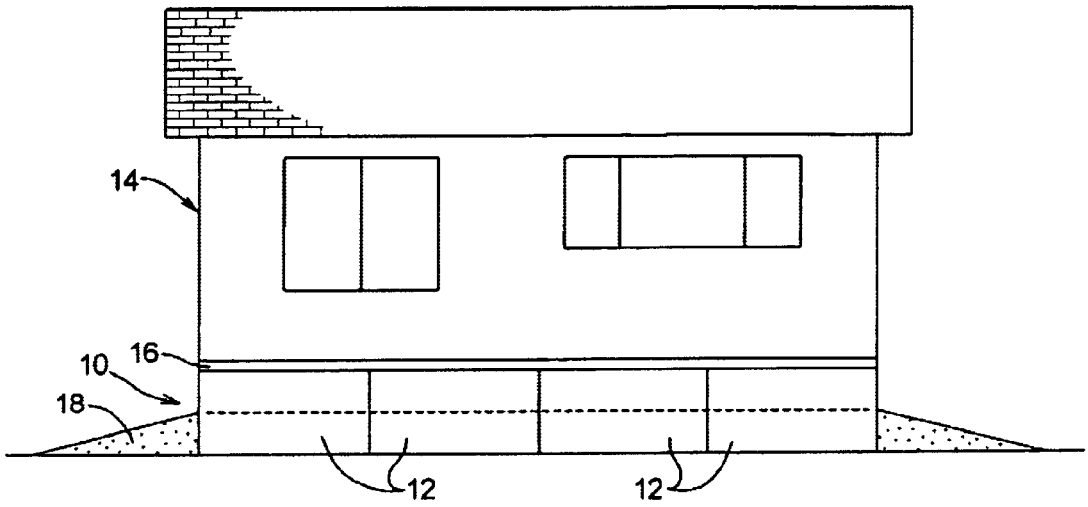
FIG. 1 is an elevational, environmental view of a manufactured home having an installed concrete panel skirting system in accordance with the present invention.

As can be seen in FIG. 1 the present invention provides a modular skirting system 10 which includes a series of pre-cast concrete panels 12. The panels are installed in an end-to-end relationship around the base of a manufactured home 14 or other building. The upper edges of the skirting panels are attached to the wooden rim joist 16 that extends about the perimeter of the structure and the lower edges rest on the underlying ground. As will be described in greater detail below, the adjoining end edges of the panels are provided with vertically extending slots which receive and engage cooperating flanges on downwardly extending metal key members that are nailed or otherwise mounted to the rim joist.

Because of their modular configuration and also because of the innerfitting edge structure, the panels 12 can be installed to complete the skirting within a matter of hours, as compared to days when used conventional wood skirting. Furthermore, in most instances, the concrete panels and associated hardware will also be less expensive than wood construction. Still further, the concrete is not affected by rot or other deterioration when soil 18 is back-filled against it, as is shown in FIG. 1.

It will be understood that the term "manufactured home" as used herein includes all forms of buildings that are premanufactured and then transported to an installation site, whether intended as a residence or for other purposes.

Furthermore, the term "concrete" as used herein includes all suitable forms of cementitious materials, whether containing aggregate material or consisting of essentially "neat" cement.

b. Modular Panels

Figure 2:
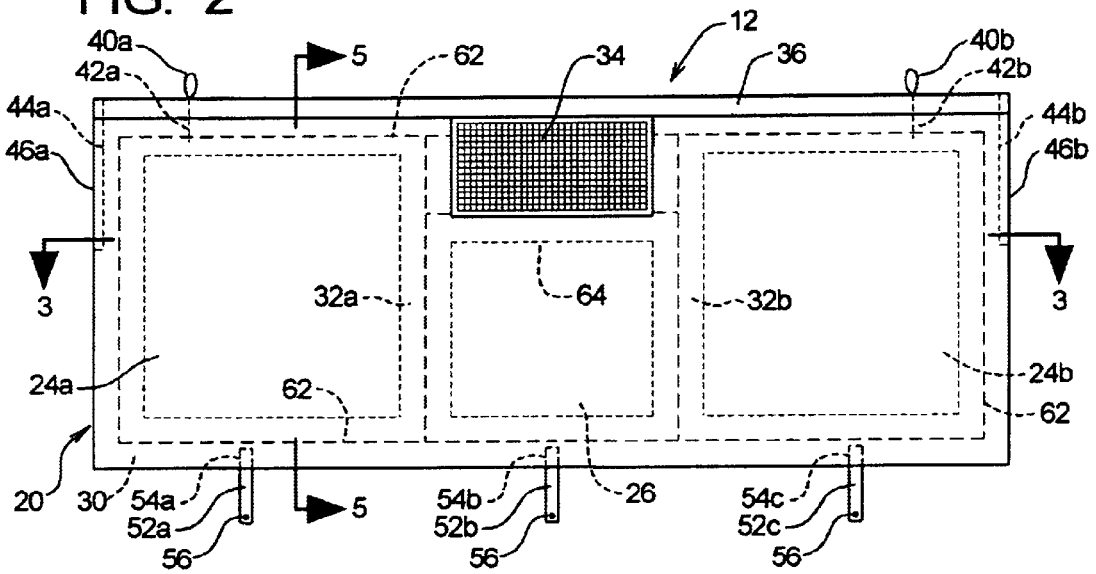
FIG. 2 is a front, elevational view of one of the concrete panels of the skirting system of the present invention, with dotted line images showing the recessed areas that are formed in the rearward side of the panel for minimizing the weight thereof.

FIG. 2 shows a cast concrete skirting panel 12 in accordance with a preferred embodiment of the present invention. Although it has been found that this configuration provides a low cost and highly effective panel for most installations, certain illustrated features or aspects may vary in other embodiments; for example, not all embodiments may include the ventilation screen which is shown in FIG. 2.

In the embodiment which is shown in FIG. 2, the panel assembly 12 includes a generally flat, rectangular concrete main casting 20 having a height suitable for spanning the gap between the ground and the rim joist of the manufactured home. The front surface of the panel casting is preferably flat and may be provided with decorative texturing or other surface ornamentation, while a series of recesses 24*a*, 24*b*, 26 are formed in its rearward surface to lighten the panel and minimize the amount of concrete required. A full thickness concrete border 30 extends around the recesses and along the perimeter of the panel casting, and additional full thickness ribs or columns 32*a*, 32*b* extend vertically through the middle portion of the panel so as to provide the necessary overall strength and rigidity.

A screen unit 34 (e.g., a molded plastic frame and screen) is mounted in the upper portion of the panel casting, above the central recessed 26. Other openings, such as flood vents, may also be included. The upper edge of the screen unit and the upper edge of the panel casting lie flush with one another, and are overlain by a wooden furring strip 36 (e.g., a length of 2×2 lumber) that receives screws or other fasteners for subsequently installed trim. The furring strip is mounted to a wire rod reinforcement frame that is imbedded in the concrete, as will be described in greater detail below. First and second wire lifting loops 40*a*, 40*b* may also be provided that extend above the furring strip, with their lower ends 42*a*, 42*b* being anchored in the underlining concrete matrix.

Figure 4:
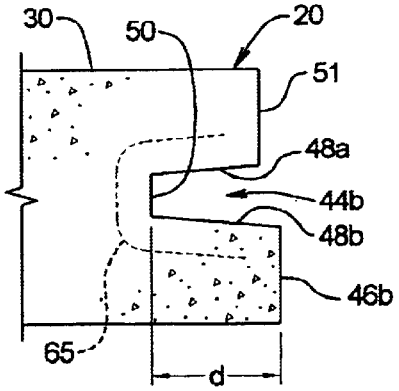
FIG. 4 is an enlarged view of the edge portion of the panel of FIG. 3, in the area indicated by reference numeral 4 in FIGS. 3, showing the edge slot, which interfits with a metal locking key so as to secure the panels to the rim joist of the building.

First and second slots 44*a*, 44*b* are formed in the vertical end edges 46*a*, 46*b* of the panel casting for engaging the metal locking keys of the assembly. As can be seen in FIG. 4 each of the slots is defined by first and second sidewalls 48*a*, 48*b* that taper inwardly and a transverse bottom wall 50 at a predetermined depth "d". As will be described in greater detail below, the edge slots are thus configured to cooperate with laterally extending flanges of the locking keys in order to secure adjoining panels in end-to-end relationship. As will be described below, the rearward edges of the slots are provided with cutaway portions 51 that accommodate the rearward flanges of the locking keys.

Metal tie-down straps 52*a–c* are in turn mounted along the lower edge of the panel casting, with their upper ends 54*a–c* again being embedded in the concrete matrix. Openings 56 are provided in the protruding ends of the metal tie-down straps for securing the lower edge of the panel to the ground during installation, as will be described in greater detail below. Metal tie-down straps suitable for use in the panel assembly 12 are available under the trademark "Simpson Strong Tie".

Figure 5:
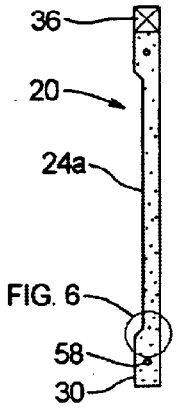
FIG. 5 is second cross sectional view of the concrete skirting panel of FIG. 2, taken along 5—5 in FIG. 2, showing the profile of the panel in greater detail and also the furring strip which extends along the upper edge of the panel attachment of a trim board on other covering.
Figure 6:
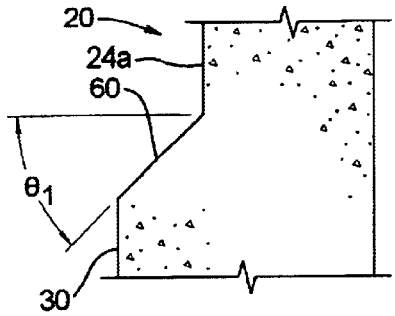
FIG. 6 is an enlarged, partial cross sectional view of the panel in the area indicated by reference numeral 6 in FIG. 5, showing the relative thickness and the profiles at the edges of the recessed areas of the panel.

FIGS. 5–6 show the arrangement of the recessed areas of the casting in greater detail. As can be seen in FIG. 6, the full thickness border portion 30 of the casting has a relatively greater thickness "$t_1$" and the recessed areas have a second, lesser thickness "$t_2$". The transition areas 60 between the full thickness and partial thickness areas are preferably sloped at an angle of about 45° so as to reduce concentration of stresses and increase strength and durability of the panel casting.

Figure 3:
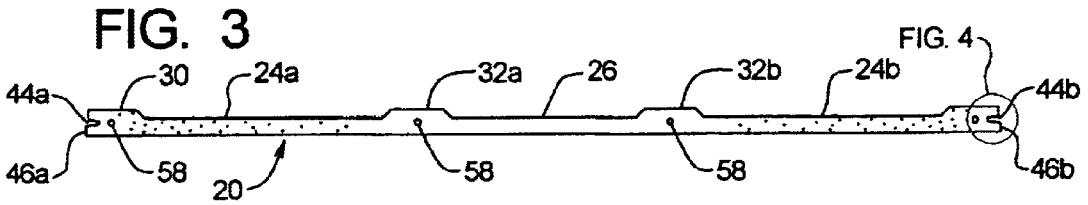
FIG. 3 is a cross sectional view of the concrete panel of FIG. 2, taken along line 3—3 in FIG. 2, showing the continuation of the recessed areas in the rearward side of the panel in greater detail.

Reinforcement rods or wire 58 are preferably embedded within the full thickness border as well as within the vertical columns or ribs 32*a*, 32*b* (see FIG. 3). As is shown by dotted line image 62 in FIG. 2, the reinforcement rod (e.g., steel rebar) is preferably formed into a framework that follows the full thickness portions of the casting, including the full thickness header 64 that extends beneath the vent frame 34. The metal rebar is bent and/or welded at the corners, and is welded to the central frame for the vent unit, which is suitably formed of bent and/or welded steel channel material. Additional reinforcement structures may also be embedded in the border at the lower ends of the vertical ribs 32*a*, 32*b* for added strength and rigidity, and reinforcing mesh 65 may be added in the panel end slots as shown in FIGS.

Example dimensions for the panel assembly and casting that are shown in FIGS. 2–5 are set forth in the following Table A:

TABLE A

| | |
|---|---|
| Overall Length | 72 inches |
| Overall Height | 28 inches |
| Thickness of Border and Ribs ($t_1$) | 1½ inches |
| Thickness of recessed areas ($t_2$) | 1 inch |
| Width of Lower Border | 4 inches |
| Width of Upper Border | 3 inches |
| Widths of Vertical Borders and Ribs | 4 inches |
| Vent Frame ("C" channel) | 1½ inch × ½ inch × ⅛ inch |
| Vertical length of Edge Slot | 10½ inches |
| Depth of Edge Slot Depth (d) | ¾ inch |
| Edge Slot taper | ⅜ inch to ¼ inch |
| Diameter of Steel Reinforcement Rod | ⅜ inch |

It is to be understood that the foregoing dimensions are exemplary of only one preferred embodiment of the present invention, and that the dimensions may vary depending on design factors and other considerations. For example, the panels may be constructed to have any suitable length, and the height may also vary depending on size of the gap between the building and the ground on the intended height of the skirting.

In addition to the flat panels described above, angled corner panels are provided for use at the corners of the manufactured home or the building. For example, FIGS. 7–9 show a right-angle corner panel for use at a square corner, however, it will be understood that corner panels may be provided having any suitable angle.

Figure 7:
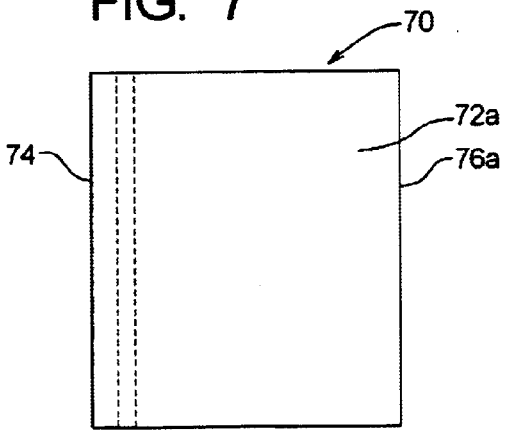
FIG. 7 is a front, elevational view of another concrete skirting corner panel in accordance with the present invention, for connecting the skirting panels at the corner of the building.
Figure 8:
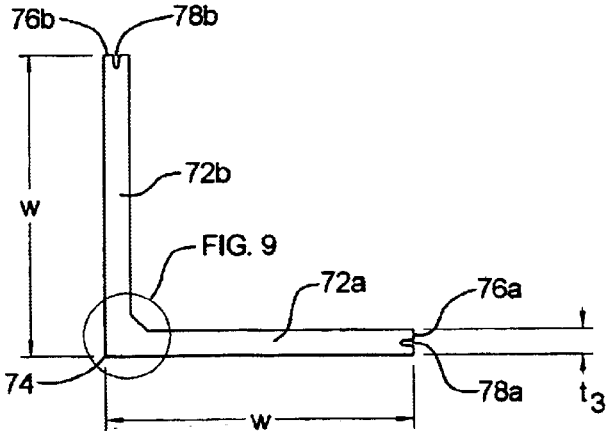
FIG. 8 is the top, plan view of the concrete corner panel of FIG. 7, showing the right angle corner segments thereof in greater detail.

As can be seen in FIGS. 7–8, the corner panel 70 includes first and second cast generally planar panel sections 72*a*, 72*b* that meet at a corner joint 74. The panel sections may have any suitable length and height, and preferably have a height that corresponds to the height of the main panel assemblies. Likewise, the vertical edges 76*a*, 76*b* of the corner assembly include edge slots 78*a*, 78*b* that match the corresponding edge slots of the main panels, for receiving the locking keys in the manner described below.

Figure 9:
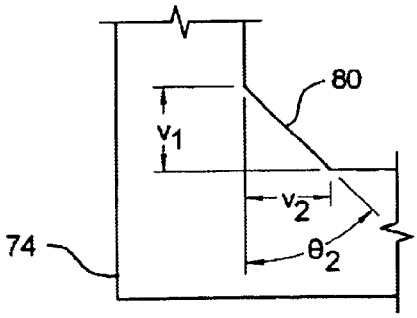
FIG. 9 is an enlarged, partial view of the corner panel of FIG. 8, in the area indicated by reference numeral 9 in FIG. 8, showing the contours at the inside corner of the panel in greater detail.

As can be seen in FIG. 9, the corner portion 74 is provided with internal gusseting 80 that extends at an angle $\theta_2$ of about 45° to the inside surfaces of the panel sections, so as to increase the strength of the assembly and again reduce stress concentrations. A wooden furring strip (not shown) is preferably mounted atop the corner panel assembly, in the same manner as the skirting panel assemblies described above.

Exemplary dimensions for the corner panel assembly shown in FIGS. 7–9 are set forth in the following Table B:

TABLE B

| | |
|---|---|
| Panel Height | 28 inches |
| Panel Width (w) | 24 inches |
| Panel Thickness ($t_3$) | 1½ inches |
| Inside gusset angle ($\theta_2$) | 45 |
| Inside gusset depth ($V_1$, $V_2$) | I inch |

Again, it will be understood that the above dimensions are exemplary only, and may vary in other embodiments depending on a variety of design factors. Also, it will be understood that the corner panel assembly may include embedded reinforcement rod or wire in a manner similar described above.

c. Panel Locking Key

FIGS. 10–13 show one of the panel metal locking keys 82 that interconnect adjoining panels in the skirting assembly when installed as shown in FIG. 1.

As can be seen, the principal component of the locking key is a vertically extending metal (e.g., steel) "T" bar 84, having a rearwardly projecting center flange 86 and laterally extending edge flanges 88*a*, 88*b*. The overall length of the "T" bar is equal to or less than the vertical length of the corresponding edge slots 44*a*, 44*b* in the concrete skirting panels.

Figure 10:
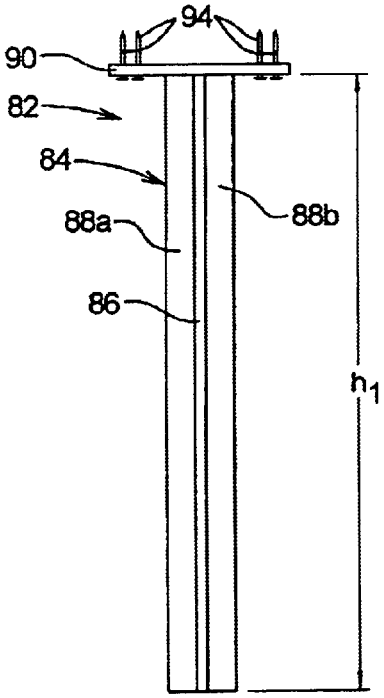
FIG. 10 is a front, elevational view of the metal locking key that inter-connects adjoining panels in the assembly and secures them to the overlying rim joist of the building.
Figure 11:
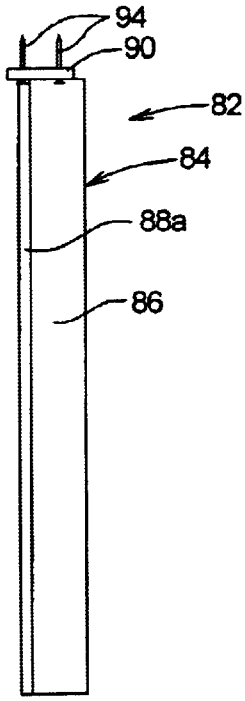
FIG. 11 is a side, elevational view of the locking key of FIG. 10, showing the forwardly projecting flange portion thereof in greater detail.
Figure 12:
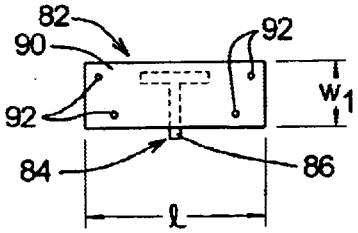
FIG. 12 is a top, plan view of the metal locking key of FIGS. 10–11, showing the upper mounting plate thereof in greater detail.
Figure 13:
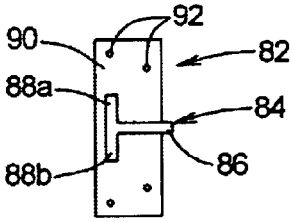
FIG. 13 is a bottom, plan of the metal locking key of FIGS. 10–11 showing the configuration of the laterally projecting flange portion thereof that interfit with the edge slots of adjoining concrete panels.

A generally flat mounting plate 90 is mounted (e.g., welded) to the upper end of the "T" bar 84 so as to extend perpendicular to the long axis of the bar. A plurality of bores 92 (see FIGS. 12–13) extend upwardly through the mounting plate, so as to permit a plurality of nails 94 or similar fasteners to be driven upwardly therethrough, as shown in FIGS. 10–11.

In some embodiments, the fasteners may be welded to or formed as a part of the mounting plate so as to expedite installation. Furthermore, the mounting plate may have an upwardly extending outer flange portion (not shown) to allow the fasteners to be driven into the rim joist from the front rather than upwardly in installations where this is required, such as where the rim joist is underlain by a steel beam along the edge of the building.

Exemplary dimensions for the panel locking key shown in FIGS. 10—13 are set forth in the following Table C:

TABLE C

| | |
|---|---|
| Overall Height of T bar ($h_1$) | 14 inches |
| Width of Edge Flanges | ⅝ inches |
| Width of Central Flanges | 1½ inches |
| Length of Mounting Plate (l) | 4 inches |
| Width of Mounting Plate ($w_1$) | 1½ inches |

Again, it will be understood that the above dimensions may vary from one embodiment to the next depending on design factors.

d. Installation

Figure 14:
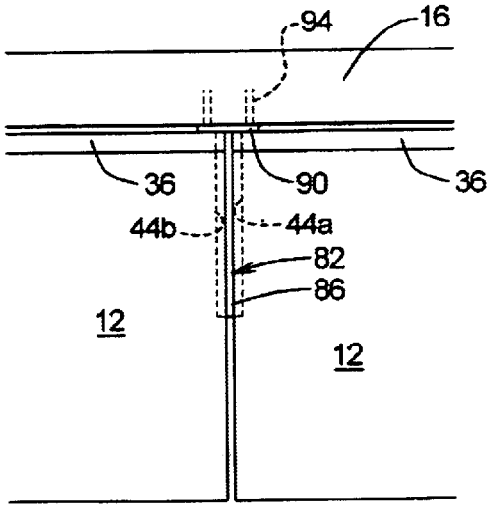
FIG. 14 is a rear, elevational view of the adjoining edges of first and second concrete skirting panels installed as shown in FIG. 1, showing the manner in which the locking key of FIGS. 10–13 interfits with the edge slots and is secured to the rim joist of the building using nails or other fasteners.

To install the skirting assembly, one or more locking keys 82 are first mounted at the edge of the manufactured home or other building, by placing the mounting flange against the bottom of the wooden rim joist 16 and driving nails 94 upwardly through bores 92; depending the assembly sequence the nails may be installed on the one side or other of the mounting plate, rather than being driven through all four of the openings as shown in FIG. 14.

The panels 12 are then placed on either side of the locking key in end-to-end relationship, so that the edge flanges of the locking key are received in interfitting engagement with the edge slots 44*a*, 44*b* of the panels and so that the vertical edges of the skirting panels butt up against and are spaced apart by the central flange 86. As this is done, the tapered edge slots permit comparatively easy initial insertion of the edge flanges on the key, and then establish a tight, stable interfit as the flange is driven home towards the comparatively narrow base of the slot; however, the key can easily be withdrawn without damaging the slot or panel in the event that the skirting is removed for subsequent installation at another site. The center flange, in turn, prevents the edge flanges from being driven too deeply into the slots and also serves to keep the edges of the concrete panels spaced just slightly apart, thus presenting an even, finished appearance and also preventing chipping or other damage to the edges of the panels. The cutaway edges 51 at the backs of the slots accommodate most of the thickness of the rearward flange so that the spacing between the edges is very small at the front of the panels, leaving only a very small gap that is quickly filled with caulk to seal the skirting and prevent a neat, virtually seamless appearance.

The key members are suitably formed of steel, however, it will be understood that in some embodiments high-strength molded plastic or other suitable materials may be used. It will also be understood that the rearwardly projecting center flanges may not be present in all embodiments.

As a next step in the installation, the anchor straps (see FIG. 2) are staked to the ground or otherwise secured in order to hold the lower edges of the panels in place. A trim board (not shown) is then nailed to the furring strips 36 to cover the joint between the panels and the rim joist 16. Corner panel assemblies (see FIGS. 7–9) are installed at the corners of the building as necessary, and the installation is completed by backfilling soil against the outer faces of the panels, if desired.

The skirting assembly of the present invention can thus be installed in a matter of hours rather than days, using inexpensive standardized components. The concrete panels are impervious to rot and other deterioration from ground contact and will therefore will last essentially the full lifetime of the manufactured home or other building. Moreover, the skirting assembly is easily removed and installed at a new location should the home or building be moved, using the same installation steps described above.

e. Casting Process

FIGS. 15–25 illustrate the molds and other components for casting the concrete panel members used in the skirting assemblies of the present invention. These molds and components facilitate the rapid and economical manufacture of the panel assemblies, although it will be understood other molding equipment and processes may be used to construct panel assemblies that fall within the scope of the invention.

Figure 15:
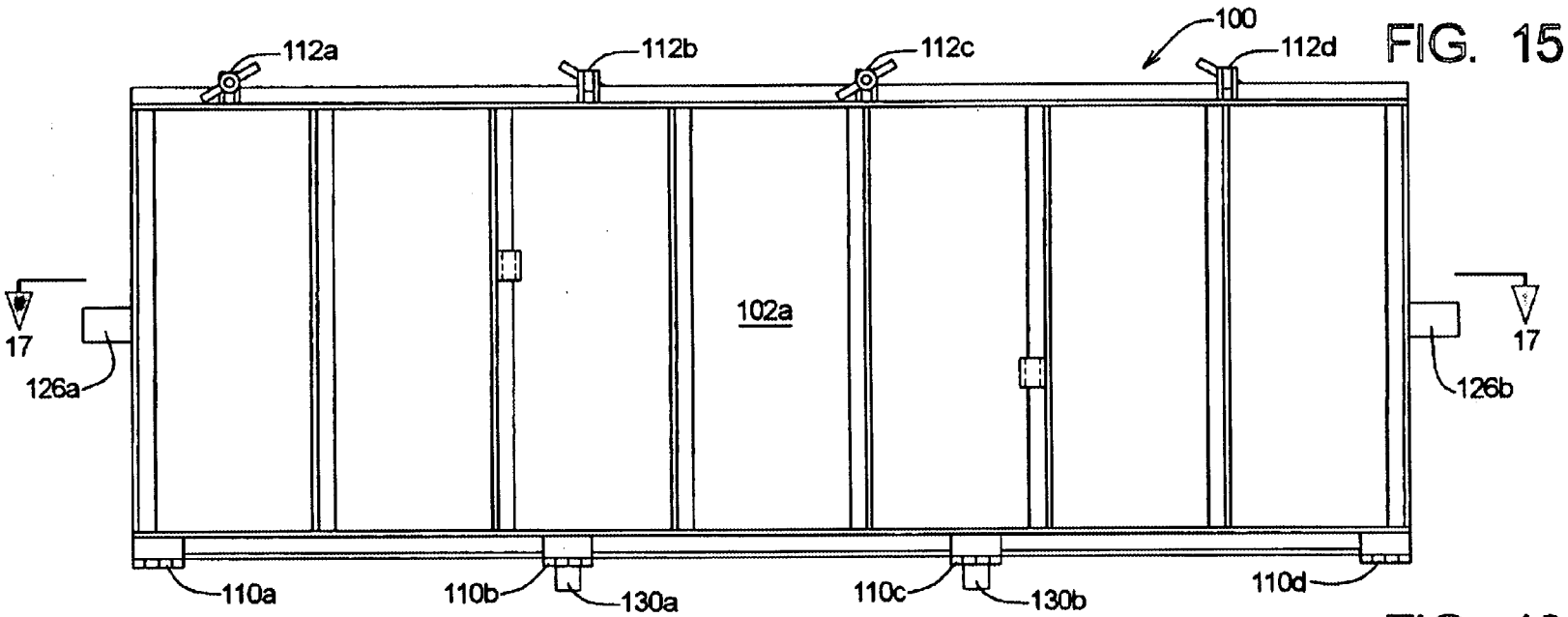
FIG. 15 is a front, elevational view of a mold assembly used to manufacture the concrete skirting panels of FIGS. 2–6, with the mold assembly being made of hinged steel panels.
Figure 16:
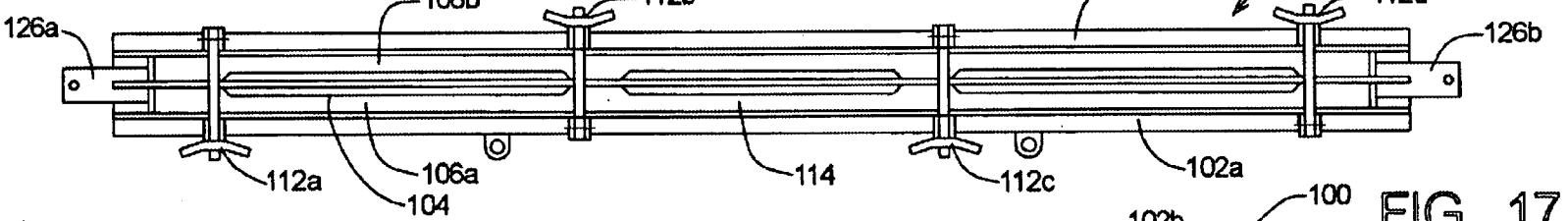
FIG. 16 is a plan view of the open top of the mold assembly of FIG. 15, showing the first and second cavities that are provided for casting two skirting panels simultaneously.
Figure 17:
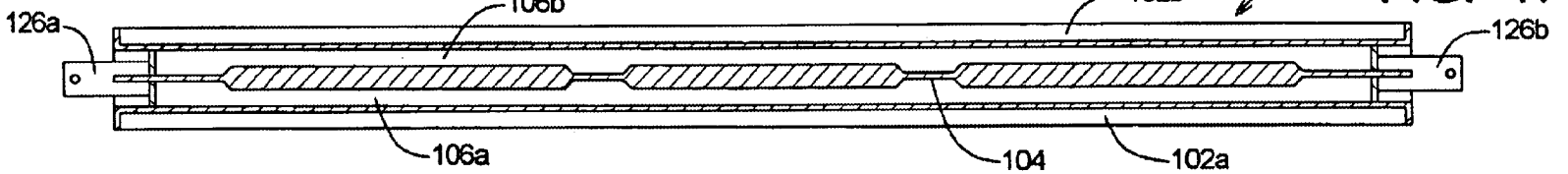
FIG. 17 is a cross sectional view, taken along line 17—17 in FIG. 15, showing the relationship of the two mold cavities and the mold bulkheads in greater detail.
Figure 18:
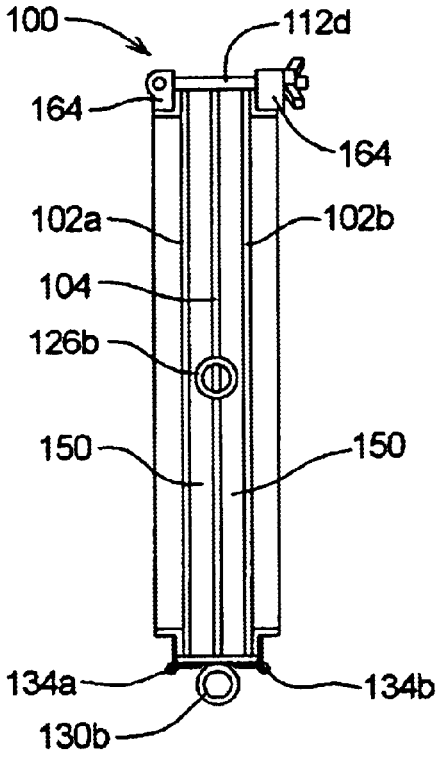
FIG. 18 is an end view of the mold assembly of FIGS. 15–17, showing the parallel relationship of the mold bulkheads and also the cylindrical supports that are mounted at each end of the assembly to permit convenient inversion thereof for casting and removal of the panels.
Figure 19:
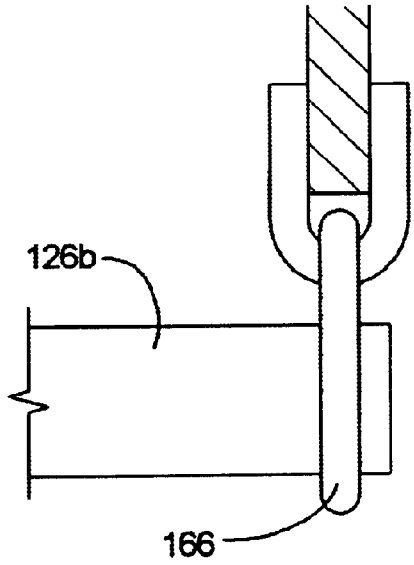
FIG. 19 is an enlarged, partial view of the end of one of the cylindrical supports, showing the manner in which this is supported pivoting relationship in a chain link or similar structure.

As can be seen in FIGS. 15–17, a preferred mold assembly 100 includes a pair of rectangular outer bulkheads 102*a*, 102*b* and a central bulkhead 104 that cooperate to define first and second mold cavities 106*a*, 106*b*. As will be described in greater detail below, the first and second mold cavities permit the concrete skirting panels to be cast in pairs simultaneously. FIG. 17 shows the bottom of the mold assembly opened to reveal the internal bulkhead and mold chambers, however, it will be understood that the bottom of the assembly is normally closed and secured together by hinge structures 110*a*–110*d*. The upper edges of the bulkheads, in turn, are secured together during casting by a series of pivoting wing bolts 112*a*–112*d*. A secondary mold cavity 114 is also provided in the upper portion of the assembly for insertion of the vent frame 34.

Figure 20:
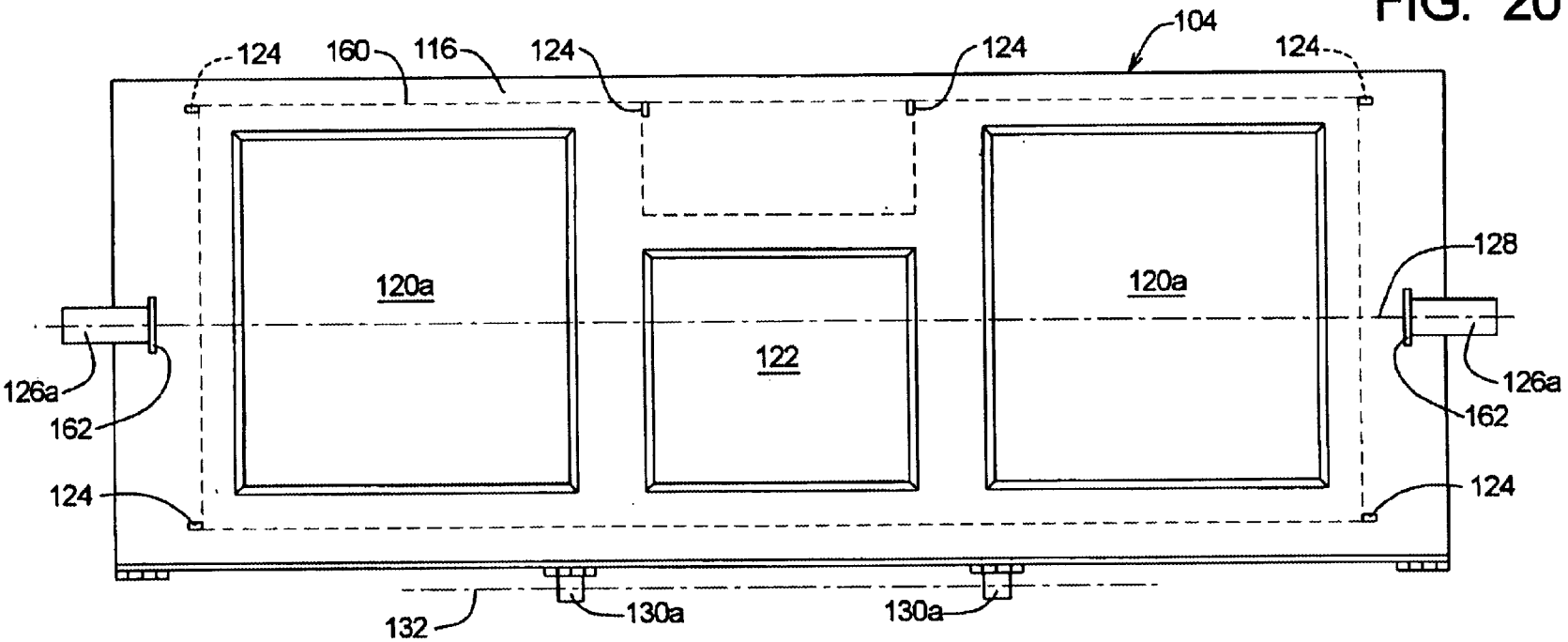
FIG. 20 is a front, elevational view of the inner bulkhead of the mold assembly of FIGS. 15–17, showing the raised panels that form the recessed areas in the concrete skirting panels and also the pipe segments that are mounted to the ends of the inner bulkhead to form the pivoting support as shown in FIGS. 18–19.
Figure 21:
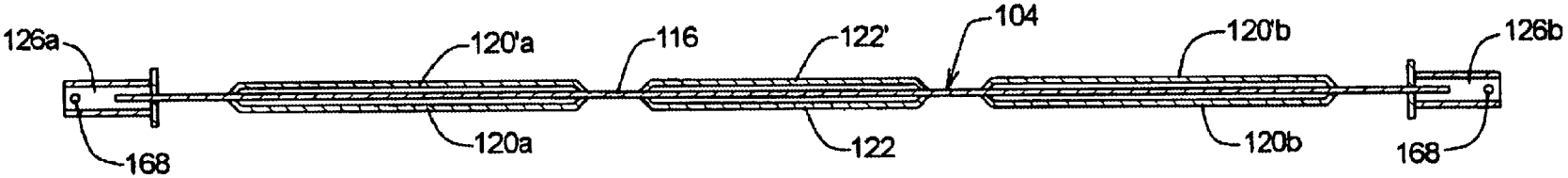
FIG. 21 is a top, plan view of the inner bulkhead of FIG. 20, showing the raised mold panels in greater detail.

As can be seen in FIGS. 20–21, the inner bulkhead 104 includes a planar central panel 116 having raised areas 120*a*, 120', 120*b*, 120*b*' and 122, 122' formed on opposite sides, which shape the recessed areas of the concrete panels during the molding process. A plurality of hooks 124 are also mounted on opposite surfaces of the central panel 116 for supporting wire rod enforcement frames so that these become embedded in the castings. First and second pipe stubs 126*a*, 126*b* are mounted on either end of the center bulkhead along a common horizontal axis 128, and first and second pipe rings 130*a*, 130*b* are mounted to the bottom of the mold assembly to form a second horizontal axis 132.

Figure 22:
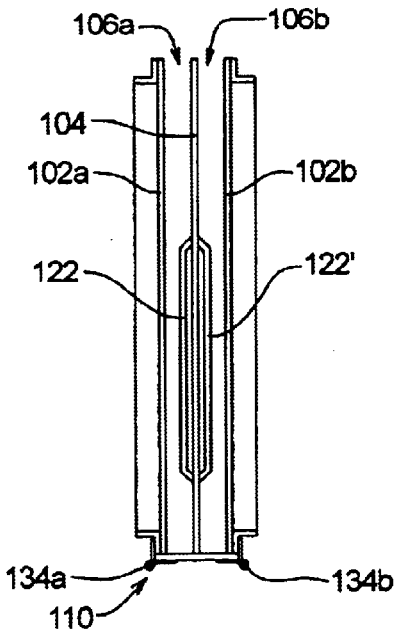
FIG. 22 is an end, cross sectional view of the mold assembly of FIGS. 15–17, showing the relationship of the inner and outer bulkheads in greater detail.
Figure 23:
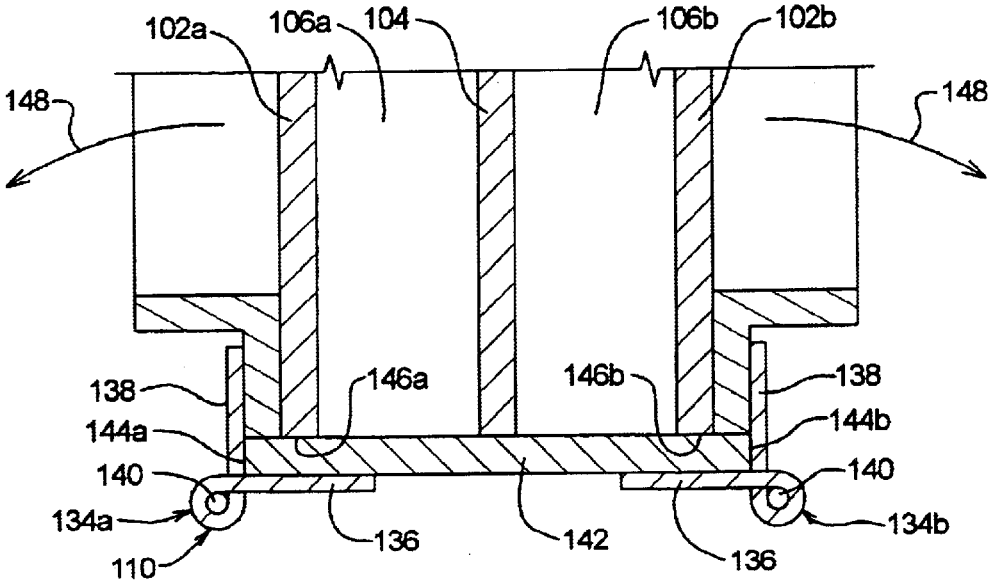
FIG. 23 is an enlarged, partial view of the lower end of the mold assembly of FIG. 22, showing the hinges that interconnect the mold bulkheads so as to permit the outer bulkheads to be pivoted away from the inner bulkhead for removal of the concrete skirting panels when cured.

FIGS. 22–23 show the hinge structures 110 in greater detail. As can be seen, each of the hinge structures includes first and second hinges 134*a*, 134*b* having a stationary plate member 136 and a pivoting plate member 138 that is joined to the stationary plate member by a hinge pin 140. The two stationary plate members are welded along opposite sides of the lower surface of the bottom dam 142 at the mold so that the pivoting plate members flatly abut the outer edges 144*a*, 144*b* of the dam when extending in a vertical direction, i.e., when extending perpendicular to the stationary plate members 136. The bottom dam 142 is in turn welded to the lower edge of the center bulkhead 104 so as to enclose the lower ends of the two mold cavities 106*a*, 106*b*.

As can be seen with further reference to FIG. 23, the pivoting plate members 138 of the hinges 134*a*, 134*b* are welded to the outer faces of the outer mold bulkheads 102*a*, 102*b*. The lower edges 146*a*, 146*b* of the outer bulkheads are positioned a spaced distance above the bases of the pivoting plate members 138 so as to flatly abut the upper surface of the bottom dam 142 when in the vertical, closed position as shown in FIG. 23, so as to form an effective seal for preventing escape of concrete during casting. Then, following curing of the concrete the latches 112 are released and the hinges allow the two outer bulkheads to pivot outwardly for removal of the cast panels, in the direction indicated by arrows 148.

Figure 24:
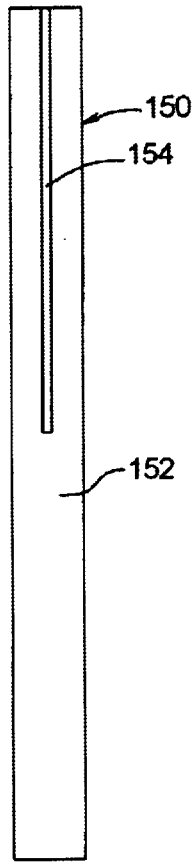
FIG. 24 is front, elevational view of a bulkhead key mold that is placed in the ends of the mold cavities in the assembly of FIGS. 15–17, so as to form the slots in the ends of the concrete skirting panels that interfit with locking key of FIGS. 10–11 when installed.
Figure 25:
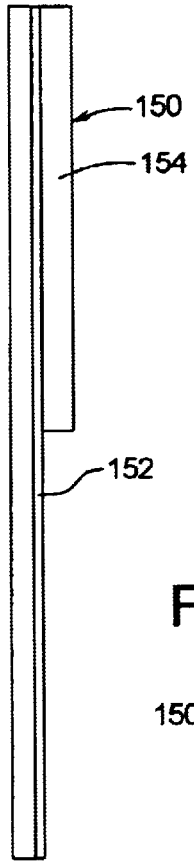
FIG. 25 is a side, elevational view of the key mold of FIG. 24, showing the forwardly projecting flange portion thereof in greater detail.
Figure 26:
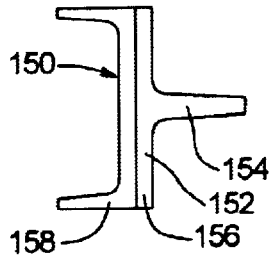
FIG. 26 is a top, plan of the key mold of FIGS. 24–25, showing the side edges thereof that engage the inner and outer bulkheads of the assembly to seal the ends of the mold cavities during casting of the concrete skirting panels.

The final enclosures for the mold cavities 106*a*, 106*b* are formed by the end dams 150 that are shown in FIGS. 24–26. The end dams are mounted in pairs in each end of the mold assembly, one at the end of each mold cavity. As can be seen, each of the end dams includes an elongate plate 152 that spans the gap between the inner and outer bulkheads and serves to block the end of the mold cavity so as to prevent the escape of uncured concrete slurry. A blade or flange portion 154 formed at one end that projects inwardly towards the associated mold cavity. The blade portions serve to form the end slots in the panel castings (see FIGS. 2–4) and are therefore sized with corresponding dimensions and contours. In that there is one end dam 150 for each end of the two mold cavities 106*a*, 106*b*, the mold assembly 100 includes four end dams in all. As can be seen in FIG. 26, the end dams are suitably constructed by welding lengths of steel T-bar 156 back to back against steel channel 158, thereby providing the end dams with sufficient rigidity and also forming comparatively wide edge surfaces for forming effective seals against the adjoining surfaces of the inner and outer bulkheads.

Casting of the skirting panels using the mold assembly 100 is accomplished is as follows. Firstly, the wire rod reinforcement frame is placed on the support hangers 124 on each side of the central bulkhead, as indicated by dotted line image 160 in FIG. 20, with the furring strip being mounted along the upper edge of the frame. The outer bulkheads 102*a*, 102*b* are then pivoted about hinges 110 to their vertical orientations, parallel to the internal bulkhead 104. The end dams 150 are fitted between the inner and outer bulkheads at the end of each mold cavity, and are held against outward displacement by shoulders 162 on the inner ends of the pipe stubs 126*a*, 126*b* (see FIG. 20). The pivoting wing bolts 112 are then placed over the tops of the bulkheads, so that the depending lugs 164 thereof hold the upper edges of the bulkheads together in slight compression, so as to secure the mold assembly in its closed, sealed configuration. A vent grate 34 (see FIG. 2) or other fitting may also be inserted between the inner and outer bulkheads so as to be held in place by the assembly, or a removable wooden block may be placed in this area to keep it clear of concrete for subsequent installation of the vent frame. Where additional openings are desired, these can be formed by placing foam knock-out pieces at the desired locations in the mold cavities, so that the foam pieces can subsequently be removed to form the openings.

The closed assembly is suspended by chain links 166 or by stationary yokes or other supports that are support pipe stubs 126*a*, 126*b* in rotating engagement therewith; as this is done, toggle pins or similar fasteners are inserted through openings 168 (see FIG. 21) so as to prevent the links or other supports from slipping off the stubs. The closed assembly is then inverted so that the furring strip forms a removable lower dam and the mold cavities are filled with cement or concrete slurry through the open upper ends (see FIG. 16). The ends of the tie down straps are then embedded in the exposed slurry.

After the cement/concrete reaches an at least partially cured state, the mold assembly is again inverted by rotating the pipe stubs 126*a*, 126*b* within their supporting links or yokes. The wing bolts 112 are released and the outer bulkheads 102*a*, 102*b* are then pivoted outwardly using the hinge assemblies 110 (see arrows 148 in FIG. 23), with the pivoting wing bolts acting as stands to support the bulkheads horizontally above the floor. The now rigid skirting panels are pressure-washed to expose the aggregate surface, if desired, and then removed for curing. Finally, the end dams 150 are pulled away to expose the finished end slots 44*a*, 44*b*.

After removing the panels the mold assembly is cleaned with a hose when the bulkheads are in their open positions. The bulkheads are then coated with a release lubricant and pivoted closed, and the steps described above are repeated. In this manner, the skirting panels 12 are manufactured in a rapid and highly economical manner.

It is to be recognized that various alterations, modifications, and/or additions may be introduced into the constructions and arrangements of parts described above without departing from the spirit or ambit of the present invention as defined by the appended claims.

What is claimed is:

1. A method for skirting a manufactured home or similar building, comprising the steps of:

providing a plurality of substantially flat concrete panels having a height approximately equal to a predetermined height between a rim joist of said building and an underlying ground surface, each of said concrete panels having edge slots formed in first and second ends thereof;

providing a plurality of key members, each of said key members having a mounting position at an upper end and an elongate panel-engaging portion with first and second edge flanges for being received in said edge slots of said panel members;

mounting said upper ends of said key members to said rim joists so that said elongate panel-engaging portions of said key members extend downwardly from said rim joints; and placing said ends of said panel members against said downwardly extending panel-engaging portions of said key members that are mounted to said rim joints, so that said edge flanges of said panel-engaging portions are received in interfitting engagement with said edge slots of said panel members and so that said key members thereby secure said panel members to said building in vertical, edge-to-edge relationship.

2. The method of claim 1, wherein the step of mounting said upper ends of the key members to said rim joist of said building comprises driving fasteners through said mounting portions at said upper ends of said key members and into said rim joists.

3. The method of claim 2, further comprising the step of securing lower edges of said panel members to said underlying ground.

4. The method of claim 3, wherein the step of securing said lower edges of said panel members to said underlying ground comprises:

providing at least one a tie-down member mounted to said lower edge of each panel member; and driving at least one fastener through said tie-down member into said underlying ground.

5. The method of claim 1, comprising the step of:

backfilling soil against outer surfaces of said concrete panels secured to said building.

6. A modular panel member for skirting a manufactured home or similar building, said panel member comprising:

a generally flat, concrete panel having:

an upper edge for fitting beneath a rim joist of said building;

a lower edge for resting on underlying ground beneath said building;

first and second ends for extending downwardly from said rim joist towards said underlying ground; and edge slots formed in said first and second ends for receiving edge flanges of elongate, downwardly-extending panel-engaging portions of key members that are mounted to said rim joist of said building, said edge slots being tapered inwardly so that said edge slots permit easy initial insertion of said edge flanges and then cooperate therewith to establish a tight interfit as said panel member is pressed towards said depending panel-engaging portion of said key member, so that said key members secure adjoining panel members in vertical, edge-to-edge relationship beneath said rim joist.

7. The panel member of claim 6, further comprising:

a wire-rod reinforcement frame embedded within cast concrete forming said panel.

8. The panel of claim 7, further comprising:

at least one vent frame for permitting flow of air therethrough once said panel member has been installed.

9. The panel member of claim 7, further comprising:

at least one recessed area for reducing a total weight of said panel member.

10. The panel member of claim 9, wherein said recessed area is formed within a thickened boundary in which said wire rod reinforcement frame is embedded.

11. The panel member of claim 10, further comprising:

at least one sloped transition area between said recessed panel and said thickened border for reducing concentration of stresses and increasing strength of said panel.

12. The panel member of claim 6, wherein said edge slots extend over only an upper portion of a total height of said ends of said panel member.

13. The panel member of claim 12, wherein said edge slots have cutaway rearward edge portions for receiving a rearwardly-extending flange of said key member therein, so that forward edge portions of said edge slots meet in substantially edge-to-edge abutment when installed with to said key members therein.

14. The panel member of claim 6, further comprising:

a wood furring strip mounted atop said upper edge of said concrete panel for receiving fasteners that attach trim material to said panels when secured to said building.

* * * * *